US010274288B2

(12) United States Patent
Mallon et al.

(10) Patent No.: US 10,274,288 B2
(45) Date of Patent: Apr. 30, 2019

(54) MISSILE FOR USE IN A LASER BEAM RIDING MISSILE GUIDANCE SYSTEM

(71) Applicant: Thales Holdings UK Plc, Surrey (GB)

(72) Inventors: Paddy Mallon, Surrey (GB); George McConnell, Surrey (GB)

(73) Assignee: THALES HOLDINGS UK PLC, Berkshire (GB)

( * ) Notice: Subject to any disclaimer, the term of this patent is extended or adjusted under 35 U.S.C. 154(b) by 0 days.

(21) Appl. No.: 15/432,294

(22) Filed: Feb. 14, 2017

(65) Prior Publication Data

US 2017/0321994 A1 Nov. 9, 2017

(30) Foreign Application Priority Data

Feb. 15, 2016 (GB) ..... 1602648.6

(51) Int. Cl.
*F41G 7/26* (2006.01)
*F41G 7/00* (2006.01)
(Continued)

(52) U.S. Cl.
CPC ..... *F41G 7/26* (2013.01); *F41G 7/008* (2013.01); *F41G 7/226* (2013.01); *F41G 7/2293* (2013.01); *F41G 7/36* (2013.01)

(58) Field of Classification Search
CPC ..... F41G 7/226; F41G 7/2266; F41G 7/222; F41G 7/2246; F41G 7/26; F41G 7/24; F41G 7/263; F41G 7/266
(Continued)

(56) References Cited

U.S. PATENT DOCUMENTS 3,363,858 A 1/1968 Dobbins et al.
4,085,910 A * 4/1978 Baker ..... F41G 7/008 244/3.16
(Continued)

FOREIGN PATENT DOCUMENTS

DE 2918858 A1 11/1980
DE 4416211 A1 11/1995
(Continued)

OTHER PUBLICATIONS

Extended European Search Report for EP Application No. 17154263, dated Jun. 29, 2017.
(Continued)

*Primary Examiner* — John Cooper
(74) *Attorney, Agent, or Firm* — Hauptman Ham, LLP

(57) ABSTRACT

A method for aligning a missile with a target in a laser beam riding missile guidance system, the system including a laser transmitter for generating and projecting a laser information field towards the target and an optical sight for aiming the laser beam towards the target, the method comprising: determining a point in the laser information field with which the missile is currently aligned; determining a distance of the target from the missile; determining an angular displacement between the missile's current direction of travel and the direction in which the target lies from the missile; determining, based on said distance and angular displacement, a new point in the laser information field with which the missile should be aligned to reach the target; and controlling missile guidance systems on board the missile to bring the missile into alignment with the new point in the laser information field.

17 Claims, 6 Drawing Sheets

(51) Int. Cl.
*F41G 7/22* (2006.01)
*F41G 7/36* (2006.01)

(58) Field of Classification Search
USPC ..... 244/3.13, 3.12, 3.16
See application file for complete search history.

(56) References Cited

U.S. PATENT DOCUMENTS 4,111,385 A * 9/1978 Allen ..... F41G 7/26 244/3.13
4,407,465 A * 10/1983 Meyerhoff ..... F41G 7/2293 244/3.16
5,601,255 A 2/1997 Romer et al.
5,944,281 A * 8/1999 Pittman ..... F41G 7/32 244/3.12
6,606,066 B1 * 8/2003 Fawcett ..... F41G 7/008 343/725
7,397,019 B1 * 7/2008 Byars ..... G01S 3/784 250/206.1
8,392,143 B2 * 3/2013 Burkland ..... F41G 7/002 702/104
8,451,432 B2 * 5/2013 Crawford ..... G01S 17/66 356/4.01
8,502,128 B1 * 8/2013 Streuber ..... F41G 7/001 244/3.1
2006/0049299 A1 * 3/2006 Dubois ..... F41G 7/26 244/3.13
2006/0049300 A1 * 3/2006 Dubois ..... F41G 7/26 244/3.13
2012/0218628 A1 * 8/2012 Egbert ..... F41G 7/226 359/356
2014/0138473 A1 5/2014 Yu

FOREIGN PATENT DOCUMENTS

GB 2338284 A 12/1999
RU 2582308 C1 4/2016

OTHER PUBLICATIONS

Search Report for GB Application No. 1602648.6, dated Aug. 12, 2016.

* cited by examiner

MISSILE FOR USE IN A LASER BEAM RIDING MISSILE GUIDANCE SYSTEM

This application claims priority benefit to United Kingdom Application No. GB 1602648.6, filed Feb. 15, 2016, which is hereby incorporated herein by reference in its entirety.

FIELD

Embodiments described herein relate to a missile for use in a laser beam riding missile guidance system and a method for aligning a missile with a target in a laser beam riding missile guidance system.

BACKGROUND

Beam riding is a known technique for guiding a missile to its target. In this technique, a laser beam coded in azimuth and elevation is projected towards the target, and the missile is provided with light sensors for detecting the beam. Once launched, the missile uses the sensors to correct its position to a specific location within the beam, allowing it to travel along the path of the beam towards the target.

FIG. 1 shows an example of a missile 101 being guided towards a target 103 by a laser beam riding missile guidance system. In this example, the target 103 is an aircraft, but could also be a ground based target such as a tank or a sea-based vessel.

The system comprises a laser operable to generate an intermittently projected laser beam 105. An operator uses an optical sight to align the beam with the target. The laser is scanned in lateral and vertical directions with respect to the direction in which the beam is propagating, so as to form a laser information field 107. The laser information field comprises an array of points or grid, in which the light signal at each point is modulated with information that can be used to identify that point's position within the array.

The missile 101 is provided with aft mounted sensors that can detect the signal encoded in the laser beam and so determine the missile's position with respect to the centre of the laser information field. Then, by use of appropriate guidance mechanisms (e.g. fins), the missile can adjust its position so as to remain aligned with the centre of the beam.

As shown in FIG. 1, a problem that may arise in the beam riding missile guidance system is that an optical alignment error 109 exists between the centre of the laser information field and the target aimpoint centre 111 in the optical sight. The misalignment can lead to a guidance error which can result in the missile missing the target.

SUMMARY

According to a first embodiment, there is provided a method for aligning a missile with a target in a laser beam riding missile guidance system, the system including a laser transmitter for generating and projecting a laser information field towards the target and an optical sight for aiming the laser beam towards the target, the method comprising:

- determining, based on light received from the laser beam at the missile, a point in the laser information field with which the missile is currently aligned;
- determining a distance of the target from the missile;
- determining an angular displacement between the missile's current direction of travel and the direction in which the target lies from the missile;

- determining, based on said distance and angular displacement, a new point in the laser information field with which the missile should be aligned to reach the target; and
- controlling missile guidance systems on board the missile to bring the missile into alignment with the new point in the laser information field.

In some embodiments, the laser information field is generated by scanning a pulsed laser beam across a region of space, the intervals between successive laser pulses being varied as the laser scans across the region of space. The point in the laser information field with which the missile is currently aligned may be determined based on the time interval between receiving successive laser pulses.

In some embodiments, determining the new point in the laser information field comprises identifying the inter-pulse interval that corresponds to the new point in the laser information field.

In some embodiments, determining the new point in the laser information field comprises determining the spatial resolution of the laser information field at the missile's present distance from the laser source, the spatial resolution defining the lateral distance between points in the field having different inter-pulse intervals.

In some embodiments, the distance of the target from the missile is determined by comparing the distance of the target from the optical sight with the distance of the missile from the laser transmitter.

In some embodiments, the distance of the missile from the laser transmitter is determined by use of an inertial navigation system onboard the missile.

In some embodiments, data conveying the distance of the target from the optical sight is received by the missile via the laser beam.

In some embodiments, the laser transmitter is co-located with the missile launcher from which the missile is launched.

According to a second embodiment, there is provided a missile for use in a laser beam riding missile guidance system, the missile comprising:

- a light sensor for detecting light in a laser information field generated by a laser transmitter and projected by the laser transmitter towards a target;
- a target sensor for sensing an angular displacement between the missile's current direction of travel and the direction in which the target lies from the missile;
- a guidance processor unit for determining a distance of the target from the missile, the guidance processor being configured to determine, based on the detected light, a point in the laser information field with which the missile is currently aligned and to determine, based on said distance and angular displacement, a new point in the laser information field with which the missile should be aligned to reach the target;
- the missile further comprising a guidance control for controlling the flight of the missile, the guidance control being configured to bring the missile into alignment with the new point in the laser information field.

In some embodiments, the laser information field is generated by scanning a pulsed laser beam across a region of space, the intervals between successive laser pulses being varied as the laser scans across the region of space. The guidance processor unit may be configured to determine the point in the laser information field with which the missile is currently aligned based on the time interval that occurs between detecting successive laser pulses at the light sensor.

In some embodiments, when determining the new point in the laser information field, the guidance processor unit is configured to identify the inter-pulse interval that corresponds to the new point in the laser information field.

In some embodiments, in determining the new point in the laser information field, the guidance processor unit is configured to determine the spatial resolution of the laser information field at the missile's present distance from the laser transmitter, the spatial resolution defining the lateral distance between points in the field having different inter-pulse intervals.

In some embodiments, the detected light encodes data conveying the distance of the target from an optical sight of the laser transmitter. The guidance processor unit may comprise a range calculator that is configured to determine the distance of the target from the missile by comparing the distance of the target from the optical sight of the laser transmitter with the distance of the missile from the laser transmitter.

In some embodiments, the missile comprises an inertial navigation system for determining the distance of the missile from the laser transmitter.

In some embodiments, the laser transmitter is co-located with the missile launcher from which the missile is launched.

In some embodiments, the missile comprises one or more guidance fins and the guidance control is configured to control the flight of the missile by adjusting the fin(s).

According to a third embodiment, there is provided a laser transmitter for generating a laser information field and projecting the laser information field towards a target; and a missile according to the second embodiment.

BRIEF DESCRIPTION OF DRAWINGS

Embodiments of the invention will now be described by way of example with reference to the accompanying drawings in which.

DETAILED DESCRIPTION

Figure 1:
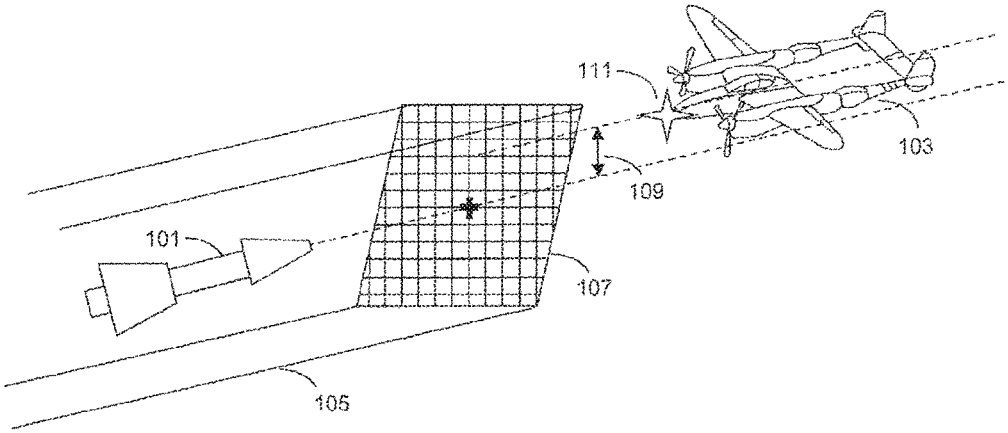
FIG. 1 shows an example of a missile being guided towards a target by a laser beam rising missile guidance system.

Embodiments described herein can help to reduce or remove a primary source of guidance error in a Laser beam riding Line of sight (LBR LOS) missile system, namely the alignment error associated with the centre of the laser beam pattern and the target aimpoint in the optical sight. By doing so, the system can be used to engage smaller targets such as unmanned aerial vehicles (UAVs) and rockets, artillery and mortars (RAMs).

An embodiment will now be described with reference to FIG. 2, which shows a missile 201 being launched towards a target 203 which is viewed in the optical sight 205. In this case, the target 203 is an aircraft. The missile 201 may be used to carry an explosive device for detonation at the target 203. The missile flies along the centre of the Laser Information Field 207, projected from the laser transmitter 209. The laser transmitter and optical sight both form part of the same device that is used to launch the missile 201; that is, the laser transmitter and optical sight are co-located with the missile launcher 211.

Figure 2:
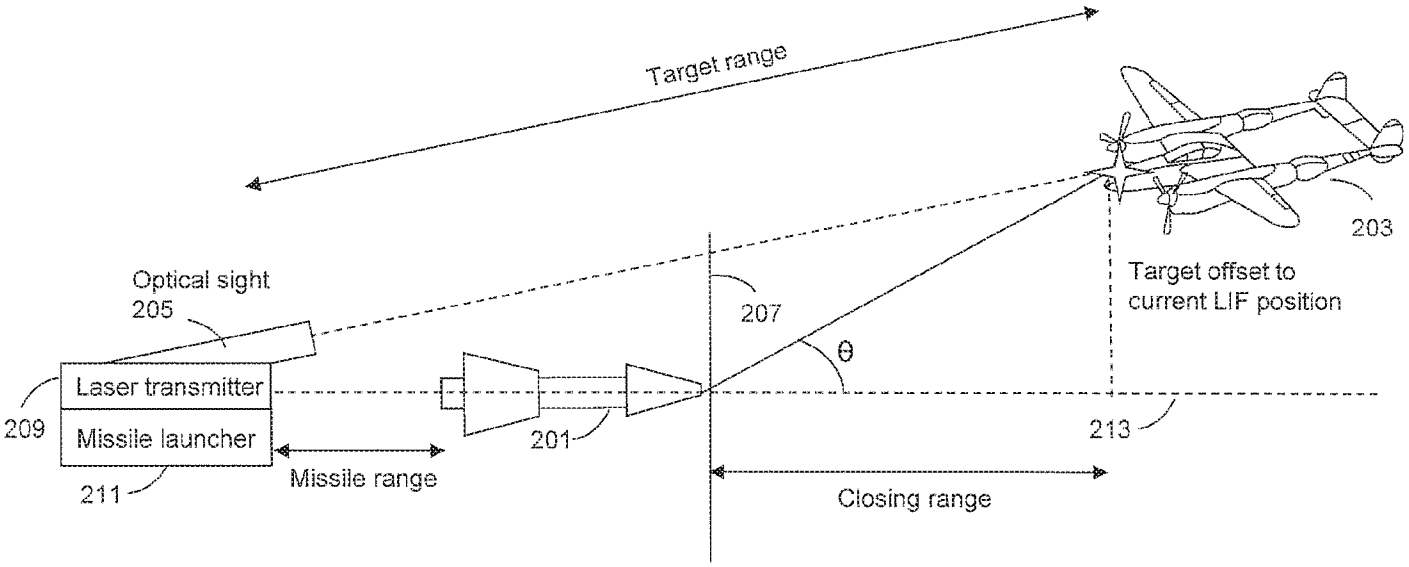
FIG. 2 shows a schematic of a missile in a laser beam riding missile guidance system according to an embodiment.

The laser information field 207, shown in cross section in FIG. 2, encodes spatial information that can be used by the missile to determine its position within the laser beam (it will be understood that, although the laser information field is shown at a single position along the beam length in FIG. 2, in practice, the laser information field will be present along the entire length of the beam). In the present embodiment, the laser information field 207 is generated by operating the laser transmitter 209 in a pulsed mode and scanning the beam in the horizontal and vertical directions, perpendicular to its direction of propagation. As the beam is scanned, the intervals between successive laser pulses are varied, such that the intervals detected by the missile vary across the height and width of the Information field.

As shown in FIG. 2, the axes of the optical sight 205 and the laser transmitter 209 may have an offset due to mechanical tolerancing and thermal effects. As a result, the missile 201 is misaligned with the target. Specifically, the target 203 is displaced by an angle θ from the missile velocity vector 213. In this context, the term "missile velocity vector" refers to the axis of the direction of travel of the missile 201.

As will be discussed in more detail below, in order to realign itself with the target, the missile 201 will perform calculations based on a number of parameters, including the "target range", "missile range" and "closing range". The target range defines the true distance along the line of sight of the target 203 from the optical sight 205, whilst the missile range defines the distance of the missile 201 along the line of sight from the laser transmitter 209.

The target range may be measured on one of several ways known in the art. For example, the target range may be determined using a (separate) laser range finder provided in the same unit as the missile launcher/optical sight; alternatively, the target range may be determined by use of a radar based system, again associated with the same unit as the missile launcher/optical sight. Other conventional means for determining the distance from the optical sight to the target may also be employed. The target range may be communicated to the missile using the laser transmitter 209; that is, in addition to the spatial information encoded in the inter-pulse separation, the laser beam emitted from the laser transmitter 209 may also be used to transmit data to the missile 201 indicating the target range.

As discussed above, the optical sight 205 and laser transmitter 209 are co-located with one another and the missile launcher 211; this means that the target range and missile range are both measured from the same point of origin (in practice, the nature of these devices means that the optical sight and the output of the laser transmitter may be offset from one another slightly; however, since the target range will typically be of the order of one or more kilometers, the assumption that the missile range and target range originate from the same point is valid for the purpose of correcting the missile's trajectory).

The closing range defines the distance of the target 203 from the missile 201, as measured along the current direction of travel of the missile 201. It will be understood that FIG. 2 is provided by way of illustration only and in practice, the misalignment between the target 203 and the missile 201 (i.e. the angle θ) will be much smaller than that shown—typically of the order of 1 mRad or below. As a result, the closing range can be determined to sufficient accuracy by simply subtracting the missile range from the target range.

Figure 3:
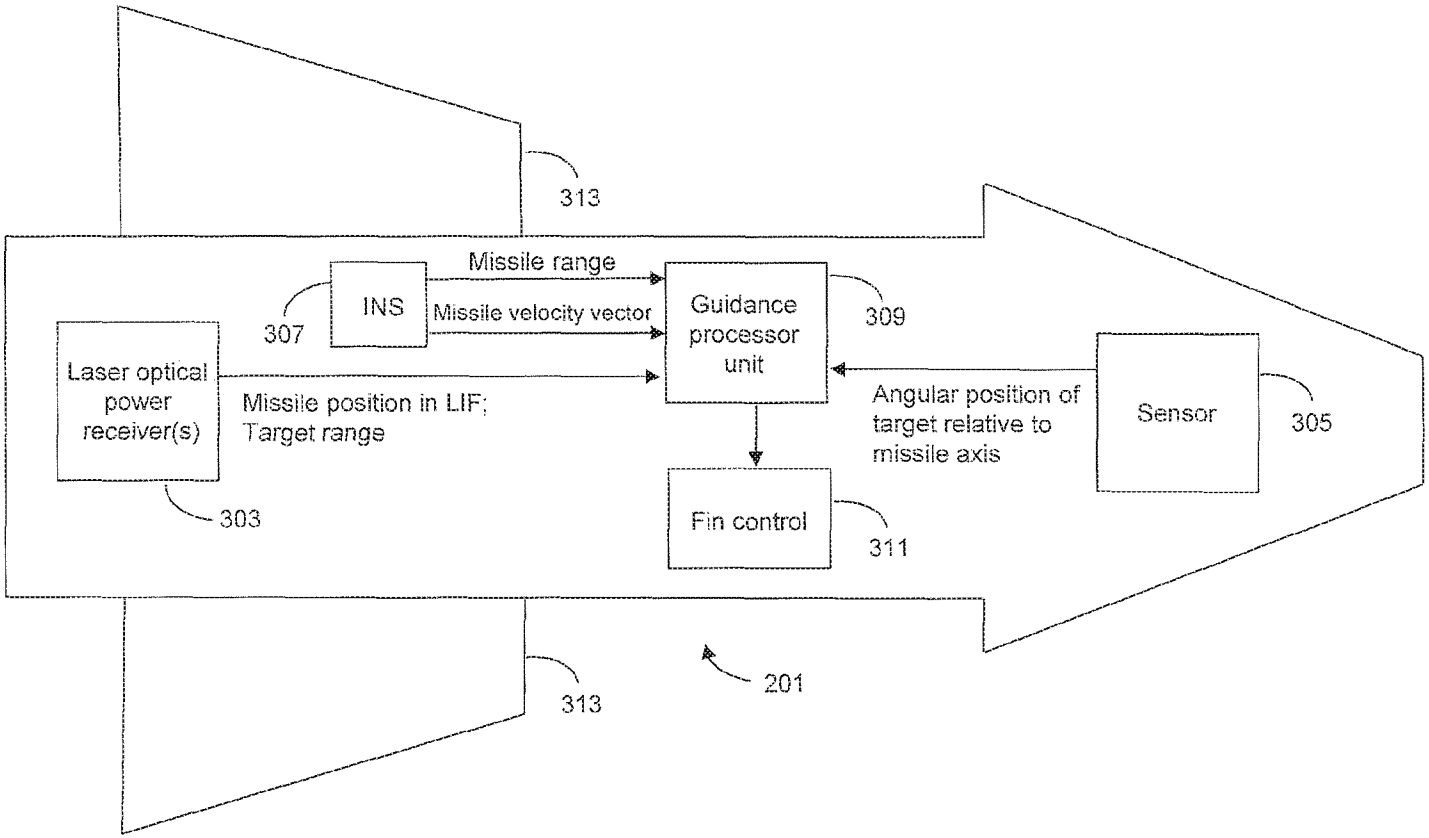
FIG. 3 shows components of the missile shown in FIG. 2.

FIG. 3 shows the components of the missile 201 in more detail. The missile includes one or more laser optical power receivers 303, for detecting light in the laser information field. The optical power receivers are, for example, aft mounted, so as to face towards the laser transmitter 209. By detecting the pulse-to-pulse intervals, the laser optical power receiver(s) 303 are able to determine the position of the missile with respect to the centre of the laser information field 207. In addition, the laser optical power receiver(s) may decode information that is contained in the laser beam and which specifies the current target range.

At the head of the missile, there is provided a sensor 305, which is used to sense the position of the target relative to the missile. The sensor may, for example, comprise a visual sensor, an infra-red sensor or a radar sensor. The sensor 305 is used to determine the angular displacement θ between the missile axis and the target. For example, the sensor may determine the target's portion in the laser information field by detecting a portion of the field reflected by the target in both the vertical and horizontal directions. The sensor will have a defined field of view (FOV) and the angular offset θ can be computed based on the location of the target in that field of view.

The missile 201 also includes an Inertial Navigation System (INS) 307, used to determine the missile's position in space relative to its point of origin (i.e. the missile launcher, and correspondingly, the laser transmitter). The INS 307 may, for example, comprise one or more accelerometers and/or gyrometers for detecting changes in acceleration which can in turn be used to monitor the change in its position with respect to the origin over time. The INS 307 is used to determine the missile range and may also determine the missile's velocity vector.

The missile range and missile velocity vector, as determined by the INS 307, are input to a guidance processor unit 309. The target range and angular displacement, as determined by the optical power receiver(s) 303 and the sensor 305, respectively, are also input to the guidance processor unit 309. The guidance processor unit 309 is used to calibrate for the misalignment between the centre of the laser information field and the aimpoint on the target from the optical sight. In the present embodiment, the guidance processor unit 309 sends commands to the fin control 311 to control the position of the missile by suitable adjustment of the missile fins 313.

Figure 4:
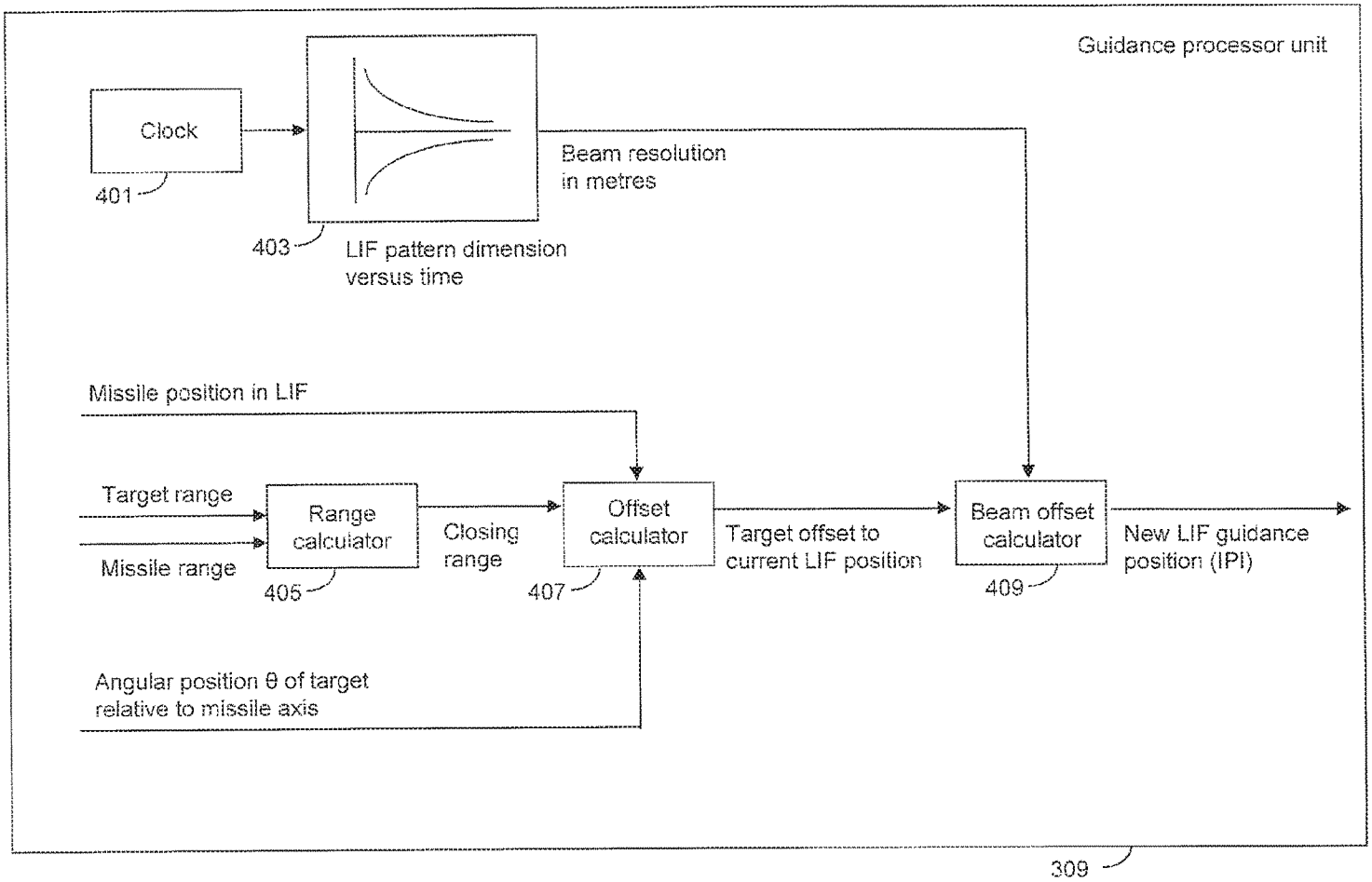
FIG. 4 shows an example of a guidance processor unit according to an embodiment.

The function of the guidance processor unit will now be explained in more detail with reference to FIG. 4. The guidance processor unit includes a clock or timer 401 and a look-up table that describes the width of the beam (more specifically, the area of the laser information field) as well as the expected inter-pulse separation at the missile location across the laser information field, as a function of time. In FIG. 4, the look-up table is depicted graphically as a plot 403 of the laser information field pattern dimension as a function of time. Based on the clock signal 401, and the look up table 403, the guidance processor unit is able to determine the expected beam resolution i.e. the grid spacing in the laser information field at a particular point in time.

The guidance processor unit also includes a range calculator 405. The range calculator 405 receives as input the target range and missile range. By subtracting the missile range from the target range, the range calculator is able to determine the closing range (i.e. the distance currently remaining between the missile and the target, as measured along the missile axis).

The closing range, as determined by the range calculator 405 is input to an offset calculator 407, together with data indicating the missile's current position in the laser information field, and the angular displacement θ between the target and the missile axis. The data indicating the missile's current position in the laser information field includes the inter-pulse separation currently being detected by the laser optical power receiver; as described above, each point in the laser information field array has an associated inter-pulse separation, which can be used to distinguish that point from others in the array. The offset calculator 407 uses the inputs it receives to determine the target offset in terms of inter-pulse intervals from the missile's current position in the laser information field. Here, the target offset refers to the lateral/vertical distance within the laser information field that the missile must travel in order to remain on course to hit the target. The target offset, as measured in inter-pulse intervals may then be used to compute the distance between the centre of the laser information field and the location in the laser information field with which the missile should seek to align itself.

The target offset is in turn input to the beam offset calculator 409. By knowing the beam resolution at the current point in time, the beam offset calculator is able to determine the coordinates in the laser information field with which the missile should seek to align itself in order to remain on course to hit the target. More specifically, the beam offset calculator 409 determines the inter-pulse separation that when detected by the missile will confirm it as being correctly aligned with the target.

Figure 5:
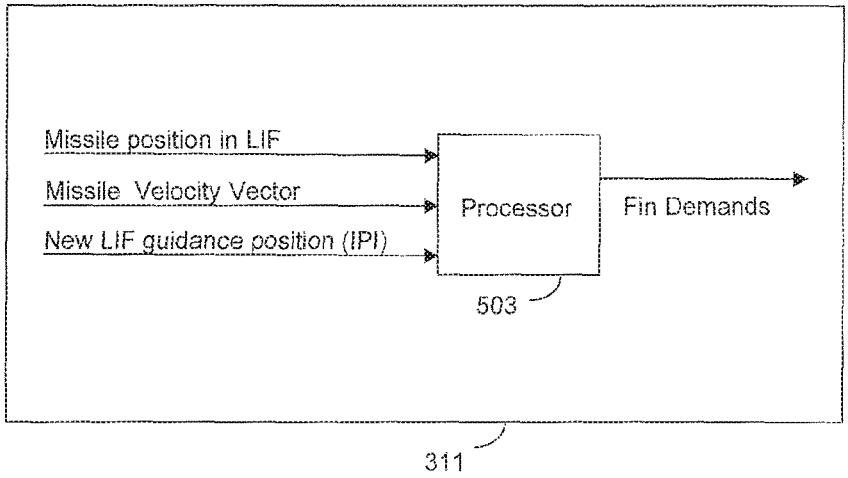
FIG. 5 shows an example of a missile guidance system according to an embodiment.

Having determined the position in the laser information field with which the missile must now align itself in order to stay on course for the target, the guidance processor issues instructions to the missile's on-board guidance systems to align the missile with the new position in the laser information field. For example, the guidance processor unit may cause the missile to adjust its fins in such a way as to cause a lateral shift in the missile's position in space. In this way, the missile calibrates for any misalignment between the centre of the laser information field and the target. FIG. 5 shows an example of the fin control 311 used to adjust the missile's position in space. The fin control includes a processor 503 that receives as input the missile's current position in the laser information field (and where appropriate the missile velocity vector) together with the new inter-pulse interval (IPI) as determined by the beam offset calculator 409 in the guidance processor unit. The processor 503 in turn generates appropriate commands that are sent to the missile fins, so as to control the motion of the missile within the laser information field.

Figure 6:
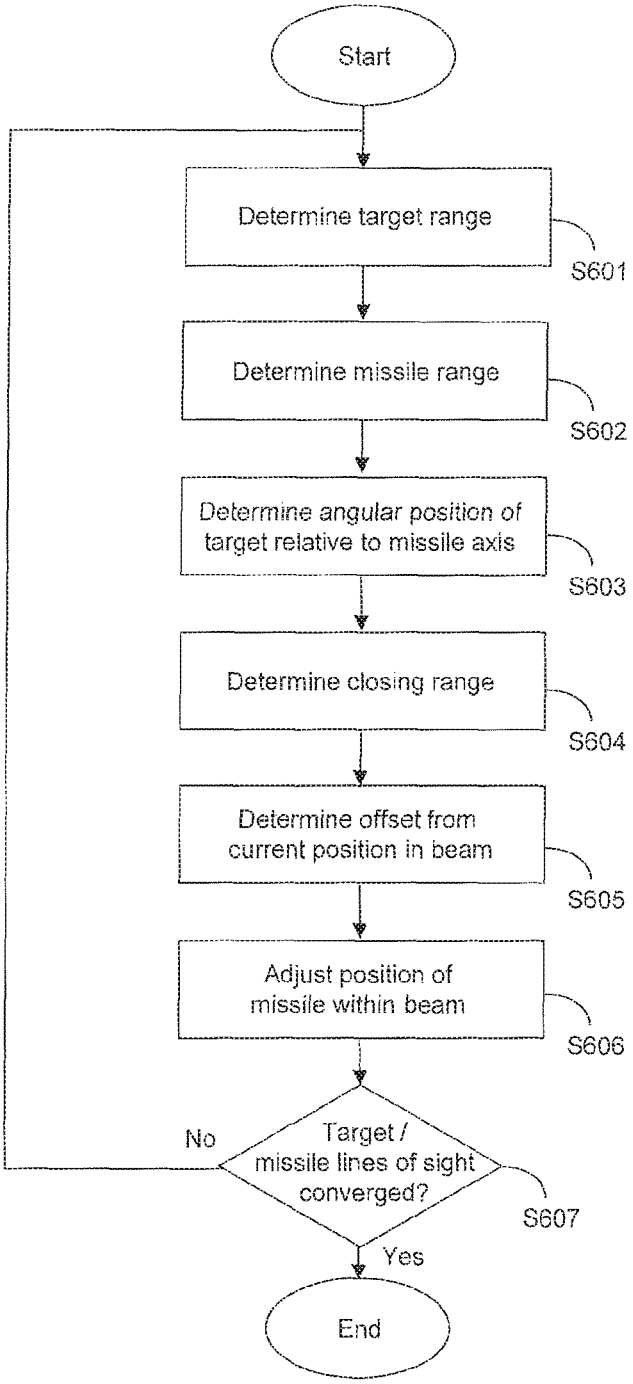
FIG. 6 shows an example of steps carried out in maintaining the alignment of a missile with a target according to an embodiment.

FIG. 6 shows a flow chart summarising the steps performed by the missile components according to an embodiment. Beginning in steps S601 and S602, the target range and missile range are determined. In step S603, the sensor on board the missile determines the angular position of the target relative to the missile axis. Then, in step S604, the closing range is calculated. In step S605, the measurements are used to determine the spatial offset between the missile's current position with respect to the laser information field and the position that the missile should adopt in order to remain on course to hit the target. In step S606, the missile's guidance systems are used to move the missile to the new position. Steps S601 to S606 then continue to repeat until target and missile lines of sight are converged.

As with conventional LBR Line of Sight (LOS) systems, the missile remains under the control of the operator throughout the engagement i.e. the missile can still be self-destructed by removal of the laser information field.

While certain embodiments have been described, these embodiments have been presented by way of example only and are not intended to limit the scope of the invention. Indeed, the novel methods, devices and systems described herein may be embodied in a variety of forms; furthermore, various omissions, substitutions and changes in the form of the methods and systems described herein may be made without departing from the scope of the invention. The accompanying claims and their equivalents are intended to cover such forms or modifications as would fall within the scope of the invention.

The invention claimed is:

1. A method for aligning a missile with a target in a laser beam riding missile guidance system, the system including a laser transmitter for generating and projecting a laser information field towards the target and an optical sight for aiming the laser information field towards the target, the missile comprising a light sensor, a target sensor, a guidance processor unit and a guidance control for controlling the flight of the missile, the method comprising:

detecting, using the light sensor onboard the missile, light in the laser information field;

determining, using the guidance processor unit onboard the missile, and based on the detected light, a point in the laser information field with which the missile is currently aligned;

determining, using the guidance processor unit onboard the missile, a distance of the target from the missile;

detecting, using the target sensor onboard the missile, a position of the target;

determining, using the target sensor onboard the missile, and based on the detected position of the target, an angular displacement between the missile's current direction of travel and the direction in which the target lies from the missile;

determining, using the guidance processor unit onboard the missile, and based on said distance and angular displacement, a new point in the laser information field with which the missile should be aligned to reach the target; and using the guidance control onboard the missile to bring the missile into alignment with the new point in the laser information field.

2. A method according to claim 1, wherein the laser information field is generated by scanning a pulsed laser beam across a region of space, the intervals between successive laser pulses being varied as the laser scans across the region of space, and the point in the laser information field with which the missile is currently aligned is determined based on the time interval between receiving successive laser pulses.

3. A method according to claim 2, wherein determining the new point in the laser information field comprises identifying the inter-pulse interval that corresponds to the new point in the laser information field.

4. A method according to claim 1, wherein determining the new point in the laser information field comprises determining the spatial resolution of the laser information field at the missile's present distance from the laser source, the spatial resolution defining the lateral distance between points in the field having different inter-pulse intervals.

5. A method according to claim 1, wherein the distance of the target from the missile is determined by comparing the distance of the target from the optical sight with the distance of the missile from the laser transmitter.

6. A method according to claim 5, wherein the distance of the missile from the laser transmitter is determined by use of an inertial navigation system onboard the missile.

7. A method according to claim 5, wherein data conveying the distance of the target from the optical sight is received by the missile via the laser information field.

8. A method according to claim 6, wherein the laser transmitter is co-located with the missile launcher from which the missile is launched.

9. A missile for use in a laser beam riding missile guidance system, the missile comprising:

a light sensor configured to detect light in a laser information field generated by a laser transmitter and projected by the laser transmitter towards a target;

a target sensor configured to detect a position of the target, and configured to determine, based on the position of the target an angular displacement between the missile's current direction of travel and the direction in which the target lies from the missile;

a guidance processor unit configured to determine a distance of the target from the missile, the guidance processor being configured to determine, based on the detected light, a point in the laser information field with which the missile is currently aligned and to determine, based on said distance and angular displacement, a new point in the laser information field with which the missile should be aligned to reach the target;

the missile further comprising a guidance control configured to control the flight of the missile, the guidance control being configured to bring the missile into alignment with the new point in the laser information field.

10. A missile according to claim 9, wherein the laser information field is generated by scanning a pulsed laser beam across a region of space, the intervals between successive laser pulses being varied as the laser scans across the region of space, and the guidance processor unit is configured to determine the point in the laser information field with which the missile is currently aligned based on the time interval that occurs between detecting successive laser pulses at the light sensor.

11. A missile according to claim 10, wherein in determining the new point in the laser information field, the guidance processor unit is configured to identify the inter-pulse interval that corresponds to the new point in the laser information field.

12. A missile according to claim 9, wherein in determining the new point in the laser information field, the guidance processor unit is configured to determine the spatial resolution of the laser information field at the missile's present distance from the laser transmitter, the spatial resolution defining the lateral distance between points in the field having different inter-pulse intervals.

13. A missile according to claim 9, wherein:

the detected light encodes data conveying the distance of the target from an optical sight of the laser transmitter; and the guidance processor unit comprises a range calculator that is configured to determine the distance of the target from the missile by comparing the distance of the target from the optical sight of the laser transmitter with the distance of the missile from the laser transmitter.

14. A missile according to claim 13, wherein the missile comprises an inertial navigation system for determining the distance of the missile from the laser transmitter.

15. A missile according to claim 13, wherein the laser transmitter is co-located with the missile launcher from which the missile is launched.

16. A missile according to claim 9, wherein the missile comprises one or more guidance fins and the guidance control is configured to control the flight of the missile by adjusting the fin(s).

17. A system comprising:

a laser transmitter for generating a laser information field and projecting the laser information field towards a target; and a missile according to claim 9.

* * * * *